US008573730B2

(12) United States Patent
Mitsuhashi et al.

(10) Patent No.: US 8,573,730 B2
(45) Date of Patent: Nov. 5, 2013

(54) TRANSPORT DEVICE, RECORDING APPARATUS, TRANSPORT METHOD

(75) Inventors: Masato Mitsuhashi, Hara-mura (JP); Yasuharu Harada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 48 days.

(21) Appl. No.: 13/214,168

(22) Filed: Aug. 20, 2011

(65) Prior Publication Data

US 2012/0056927 A1 Mar. 8, 2012

(30) Foreign Application Priority Data

Aug. 23, 2010 (JP) ..... 2010-186569

(51) Int. Cl.
*B41J 29/38* (2006.01)
*B41J 2/01* (2006.01)

(52) U.S. Cl.
USPC ..... 347/16; 347/101; 347/104

(58) Field of Classification Search
None
See application file for complete search history.

(56) References Cited

U.S. PATENT DOCUMENTS

| | | | | |
|---|---|---|---|---|
| 7,163,285 | B2 * | 1/2007 | Van Doorn et al. | 347/101 |
| 2006/0055760 | A1 * | 3/2006 | Cummins et al. | 347/104 |
| 2008/0239052 | A1 * | 10/2008 | Ishii et al. | 347/104 |

FOREIGN PATENT DOCUMENTS

| | | | |
|---|---|---|---|
| DE | 91 10 817 | U1 | 10/1991 |
| DE | 195 37 025 | A1 | 4/1997 |
| EP | 0 949 174 | A1 | 10/1999 |
| JP | 08-091658 | A | 4/1996 |

OTHER PUBLICATIONS

Extended European Search Report dated Apr. 17, 2012 as received in application No. 11178085.4.

* cited by examiner

*Primary Examiner* — Geoffrey Mruk
(74) *Attorney, Agent, or Firm* — Maschoff Brennan

(57) ABSTRACT

The transport control section performs, in a case where a first motor and a second motor are driven so as to transport a long sheet to the downstream side in a transport direction, prescribed processing that is different from the processing in a case where the deflection amount of the sheet becomes equal to or greater than a reference amount, in a case where the deflection amount of the sheet between a shaft member and a sending roller in the transport direction does not become equal to or greater than the reference amount.

11 Claims, 6 Drawing Sheets

TRANSPORT DEVICE, RECORDING APPARATUS, TRANSPORT METHOD

CROSS REFERENCES TO RELATED APPLICATIONS

The entire disclosure of Japanese Patent Application No. 2010-186569, filed Aug. 23, 2010 is expressly incorporated herein by reference.

BACKGROUND

1. Technical Field

The present invention relates to a transport device and a transport method. More specifically, the present invention relates to a transport device and transport method which transport a long medium wound in a roll form on a shaft member so as to feed the medium while rotating the shaft member. The present invention also relates to a recording apparatus incorporating the transport device.

2. Related Art

One example of a recording apparatus which performs recording on a long medium (as one example, a long sheet) wound in a roll form on a shaft member is described in Japanese Patent Doc. JP-A-8-91658. In that apparatus, the terminus of a sheet that is used in the recording apparatus is fixed to the shaft member.

A transport device for transporting the sheet in a predetermined transport direction in the recording apparatus includes a sending roller disposed further downstream in the transport direction than a housing section where the sheet wound in a roll form is housed, and a driving motor which imparts a driving force to the sending roller. Further, a detection sensor for detecting movement of the shaft member with the sheet wound thereon is provided in the housing section.

When transporting the sheet, rotation of the sending roller is transmitted to the shaft member through the sheet, so that the shaft member rotates in a predetermined rotational direction in conjunction with the rotation of the sending roller. Then, the sheet is sent little by little from the housing section and as a result, causing the sheet to be transported to a recording area on the downstream side in the transport direction. At this time, if the sheet wound on the shaft member is almost exhausted, the shaft member, to which the terminus of the sheet is fixed, moves so as to be dragged to the transport direction side of the sheet by a driving force based on the rotation of the sending roller, which is transmitted thereto through the sheet. When such movement of the shaft member is detected by the detection sensor, it is determined that the sheet has run out, and the prescribed processing of stopping driving of the driving motor is then performed.

Incidentally, moving the shaft member so as to drag it in accordance with the sheet running-out causes a great load to act on various members such as the sending roller which is used for transporting the sheet. The driving motor that is a driving source of the sending roller. If a great load is imparted to various members in this manner, the degree of abrasion of the members becomes high, such that there is a concern that a frequency of execution of maintenance or a frequency of replacement of a component may become high. Further, a method of detecting that the roll is nearly empty is found in JP-A-8-91658, which describes a method which can be adopted in a case where the terminus of the sheet is fixed to the shaft member, but which cannot be adopted in a case where the terminus of the sheet is not fixed to the shaft member.

BRIEF SUMMARY OF THE INVENTION

An advantage of some aspects of the invention is that it provides a transport device, a recording apparatus, and a transport method, in which in a case where the amount of a medium wound on a shaft member has become small, it is possible to perform prescribed processing that is different from the processing in a case where the remaining amount is sufficient, without increasing a load that is applied to various members necessary for transporting the medium.

According to a first aspect of the invention, there is provided a transport device that transports a long medium so as to send the medium downstream in a transport direction by rotating a shaft member with the long medium wound thereon in a roll form, the transport device including a sending roller that is disposed further to the downstream side in the transport direction than a housing section where the medium wound in a roll form is housed on the shaft member, wherein the sending roller sends the medium to the downstream side in the transport direction, a driving section that generates driving force for rotating the shaft member and the sending roller, a detection section that detects the deflection amount of the medium between the shaft member and the sending roller in the transport direction, and a control section that controls, at the time of transporting the medium downstream, the driving section such that the deflection amount of the medium which is detected by the detection section becomes equal to or greater than a predetermined reference amount, wherein in a case where the driving section is driven so as to transport the medium downstream in the transport direction, the control section performs prescribed processing that is different from when the deflection amount becomes equal to or greater than the reference amount, in a case where the deflection amount of the medium which is detected by the detection section does not become equal to or greater than the reference amount.

In addition, in the aspect of the invention, the terminus of the sheet is set not to be fixed to the shaft member.

According to the above configuration, in the case of transporting the long medium to the downstream side in the transport direction, the rotation of the shaft member and the rotation of the sending roller are individually adjusted such that the deflection amount of the medium between the shaft member and the sending roller in the transport direction becomes equal to or greater than the reference amount. For this reason, compared to a case where the medium is not deflected between the shaft member and the sending roller in the transport direction, a stress based on the rotation of the sending roller is not transmitted to the shaft member through the medium. As a result, at the time of transporting the medium, an increase in load that is applied to various members necessary for transporting the medium can be suppressed.

Further, in a case where the driving section is driven so as to transport the long medium to the downstream side in the transport direction, when the deflection amount of the medium does not become equal to or greater than the reference amount, it is determined that the remaining amount of the medium in the housing section has become small. This is because if the remaining amount of the medium in the housing section becomes small, since the terminus of the medium is not fixed to the shaft member, the terminus of the medium is separated from the shaft member, such that the medium cannot be sent even if the shaft member is rotated. In such a case, the prescribed processing that is different from the processing when the deflection amount of the medium between the shaft member and the sending roller in the transport direction becomes equal to or greater than the reference amount is performed. Accordingly, in a case where the remaining amount of the medium wound on the shaft member has become small, it is possible to perform the prescribed processing that is different from the processing in a case where the remaining amount is sufficient, without increasing a load which is applied to various members necessary for transporting the medium.

In the transport device according to the above aspect of the invention, it is preferable that the driving section be able to generate a first driving force that rotates the sending roller and the shaft member in a first rotational direction so as to transport the medium downstream in the transport direction and a second driving force that rotates the sending roller and the shaft member in a second rotational direction that is a direction opposite to the first rotational direction, so as to wind the medium on the shaft member, and the control section controls, in the case of winding the medium on the shaft member, the driving section such that the deflection amount of the medium which is detected by the detection section becomes equal to or less than the reference amount, and performs, in a case where the driving section is driven so as to wind the medium on the shaft member, the prescribed processing that is different from when the deflection amount becomes equal to or less than the reference amount, when the deflection amount of the medium which is detected by the detection section does not become equal to or less than the reference amount.

According to the above configuration, in the case of winding the long medium on the shaft member, the rotations in the second direction of the shaft member and the sending roller are individually adjusted such that the deflection amount of the medium between the shaft member and the sending roller in the transport direction becomes equal to or less than the reference amount. For this reason, compared to a case where the medium is not deflected between the shaft member and the sending roller in the transport direction, a stress based on the rotation of the shaft member is not transmitted to the sending roller through the medium. As a result, in the case of winding the medium on the shaft member, an increase in the load that is applied to various members necessary for transporting the medium can be suppressed.

Further, in a case where the driving section is driven so as to wind the long medium on the shaft member, when the deflection amount of the medium does not become equal to or less than the reference amount, it is determined that the remaining amount of the medium in the housing section has become small. This is because if the remaining amount of the medium in the housing section becomes small, since the terminus of the medium is not fixed to the shaft member, the terminus of the medium is separated from the shaft member, so that the medium cannot be wound even if the shaft member is rotated. In such a case, the prescribed processing that is different from the processing when the deflection amount of the medium between the shaft member and the sending roller in the transport direction becomes equal to or less than the reference amount is performed. Accordingly, in a case where the remaining amount of the medium wound on the shaft member has become small, it is possible to perform the prescribed processing that is different from the processing in a case where the remaining amount is sufficient, without increasing a load which is applied to various members necessary for transporting the medium.

In the transport device according to the above aspect of the invention, it is preferable that the detection section includes a detector that is disposed in the housing section, and the detector is disposed further outside than the outer circumferential surface of the roll-shaped medium in the diameter direction centering on the shaft member, in a case where the unused roll-shaped medium in which the medium is wound in a roll form on the shaft member is installed in the housing section.

According to the above configuration, the deflection amount of the medium in the housing section is detected using the detector that is disposed in the housing section.

In the transport device according to the above aspect of the invention, it is preferable that the driving section includes a first motor that generates a driving force for rotating the shaft member and a second motor that generates a driving force for rotating the sending roller.

In the case of controlling the rotation of the shaft member and the rotation of the sending roller with a single motor, it is necessary to provide a mechanism for adjusting the magnitude of a driving force from the motor to the shaft member and a mechanism for adjusting the magnitude of a driving force from the motor to the sending roller. For this reason, there is a possibility that the configuration and control of the driving section may be complicated. In this regard, in the invention, the first motor for the shaft member and the second motor for the sending roller are separately provided. For this reason, the configuration and control of the driving section can be simplified compared to the case of controlling the rotation of the shaft member and the rotation of the sending roller with a single motor.

According to a second aspect of the invention, there is provided a recording apparatus including the above-described transport device, and a recording section that is disposed further to the downstream side in the transport direction than the sending roller and attaches fluid to the medium.

According to the above configuration, even if the recording apparatus is provided with the transport device, the operation and the advantageous effects equivalent to those of the above-described transport device can be obtained.

In the recording apparatus according to the above aspect of the invention, it is preferable that the prescribed processing includes at least one process of a process of blocking power transmission to the shaft member, a process of giving notice of the effect that the remaining amount of the medium in the housing section has become small, a process of prompting replacement with a new medium, and a process of giving notice of a recording-processable recording amount.

According to the above configuration, in a case where it is determined that the amount of the medium in the housing section is small, at least one process of a process of blocking power transmission to the shaft member, a process of giving notice of the effect that the remaining amount of the medium in the housing section has become small, a process of prompting replacement with a new medium, and a process of giving notice of a recording-processable recording amount is performed.

According to a third aspect of the invention, there is provided a transport method that transports a long medium so as to send the medium to the downstream side in a transport direction by rotating a shaft member with the long medium wound thereon in a roll form, wherein further to the downstream side in the transport direction than a housing section for the medium wound in a roll form on the shaft member, a sending roller that rotates in order to send the medium sent from the housing section side, to the downstream side in the transport direction, is disposed, the method including: performing rotation control that rotates the shaft member and the sending roller such that the deflection amount of the medium between the shaft member and the sending roller in the transport direction becomes equal to or greater than the predetermined reference amount, and performing prescribed control that carries out, in a case where the shaft member and the sending roller rotate so as to send the medium downstream in the transport direction, prescribed processing that is different from the processing when the deflection amount becomes equal to or greater than the reference value, when the deflection amount of the medium does not become equal to or greater than the reference amount.

According to the above configuration, the operation and the advantageous effects equivalent to those of the above-described transport device can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, one embodiment embodying the invention will be described on the basis of FIGS. 1 to 5.

Figure 1:
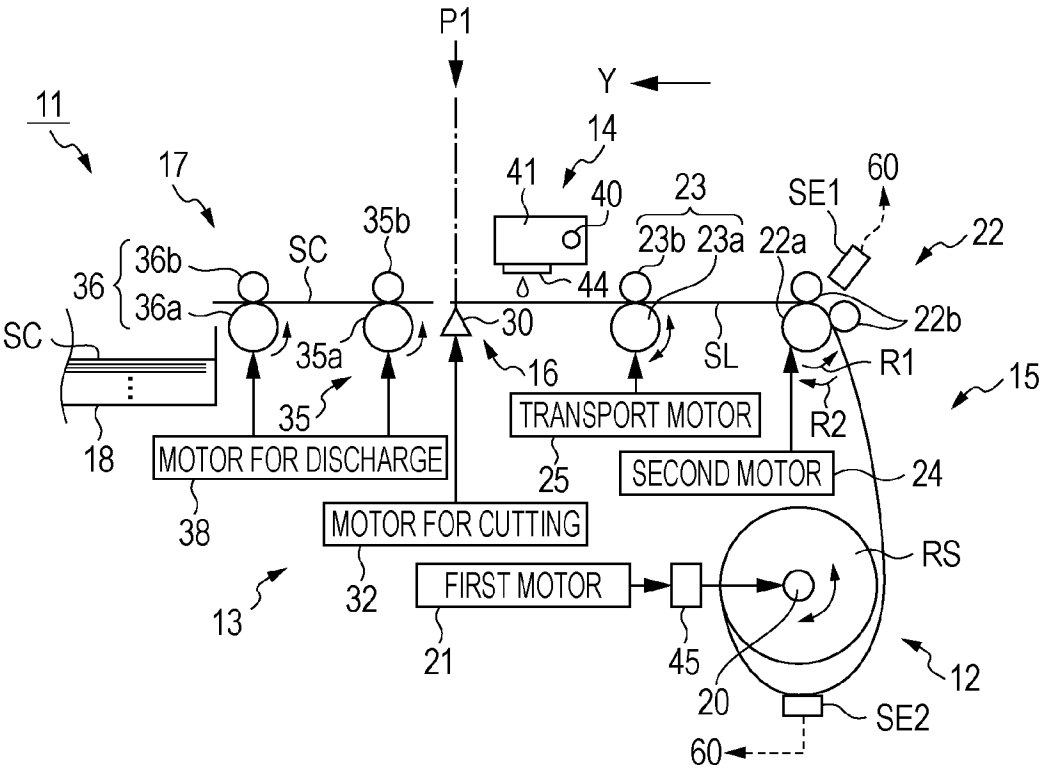
FIG. 1 is a side view schematically illustrating a recording apparatus of an embodiment of the invention.

As shown in FIG. 1, a recording apparatus 11 of the first embodiment is a serial type ink jet printer. Such a recording apparatus 11 includes a housing section 12 which houses a long sheet SL as one example of a long medium comprising rolled paper (a roll-shaped medium) RS wound in a roll form, and a transport device 13 which transports the long sheet SL by feeding it incrementally from the inside of the housing section 12. Further, a recording unit 14 serving as one example of a recording section which performs recording with respect to the long sheet SL is provided at a midway position in a transport direction Y (also referred to as a "sub-scanning direction") of the long sheet SL.

The transport device 13 includes a transport unit 15 which transports the long sheet SL from an upstream position (the housing section 12 side) in the transport direction Y toward a downstream position (the recording unit 14 side). Further, in the transport device 13, a cutting unit 16 which cuts the long sheet SL is provided at a cutting position P1 on the downstream side (in FIG. 1, the left side) in the transport direction Y of the recording unit 14. The cutting unit 16 cuts a recorded portion SC, where a recording process has been completed on the long sheet SL, from the long sheet SL. Further, at the downstream side in the transport direction Y of the cutting position P1, a discharge unit 17 is provided which discharges the recorded portion SC cut from the long sheet SL to a discharge tray 18 which is located at the most downstream side in the transport direction Y.

The rolled paper RS of this embodiment is made by winding the long sheet SL on a shaft member 20 which extends in a scanning direction (in this embodiment, it is a direction perpendicular to the plane of the paper and is also referred to as a "main scanning direction") perpendicular to the transport direction Y. In this embodiment, the terminus of the long sheet SL is not fixed to the shaft member 20. For this reason, when the sheet SL which is wound on the shaft member 20 is consumed, the terminus of the sheet SL is separated from the shaft member 20.

Figure 2:
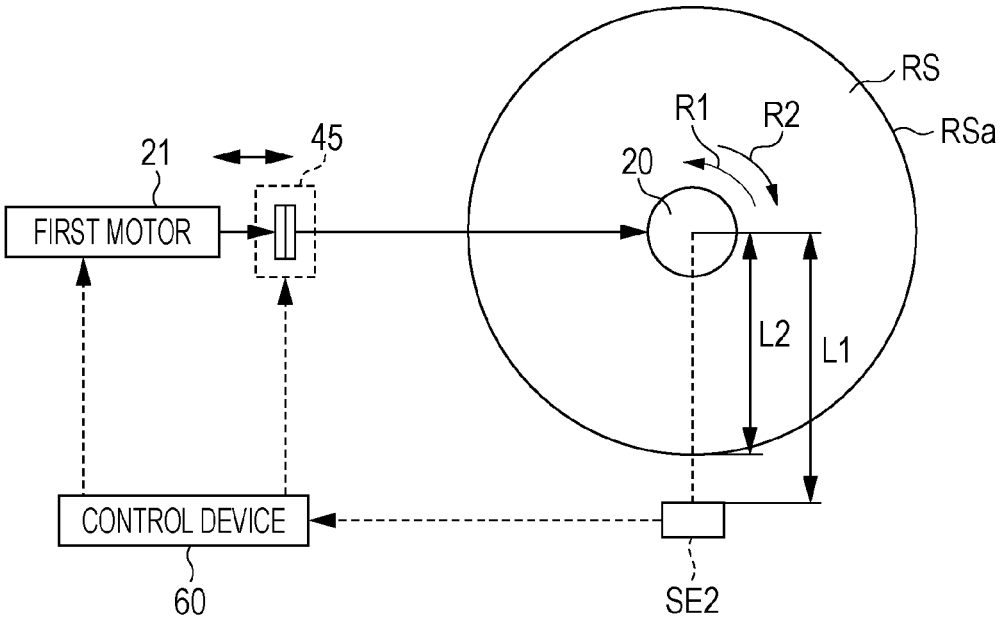
FIG. 2 is a schematic diagram describing a disposition state of a deflection detection sensor.

Further, in a case where the rolled paper RS has been set in the housing section 12, a first motor 21 is connected to the shaft member 20 through a clutch mechanism section 45 in a power-transmittable state, as shown in FIG. 2. The clutch mechanism section 45 is configured so as to enter an engagement state where transmission of power from the first motor 21 to the shaft member 20 is permitted or a release state where the power transmission is blocked, on the basis of a control command from a control device 60. In addition, an electromagnetic clutch can be given as one example of the clutch mechanism section 45.

Then, if a first driving force generated at the first motor 21 is transmitted to the shaft member 20, the shaft member 20 rotates in a first rotational direction R1, so that the rolled paper RS is sent in the form of the long sheet SL from the housing section 12 to the outside of the housing section 12. On the other hand, if a second driving force generated at the first motor 21 is transmitted to the shaft member 20, the shaft member 20 rotates in a second rotational direction R2 which is a direction opposite to first rotational direction R1, so that the long sheet SL is wound on the shaft member 20. In addition, even if the shaft member 20 is made to rotate in a state where the terminus of the sheet SL has been separated from the shaft member 20, the shaft member 20 only idles. Specifically, even if the shaft member 20 is made to rotate in the first rotational direction R1, the sheet SL is not fed from inside the housing section 12. Further, even if the shaft member 20 is made to rotate in the second rotational direction R2, the sheet SL is not wound on the shaft member 20.

Further, a contact-type deflection detection sensor SE2 serving as one example of a detector for detecting deflection of the sheet SL in the housing section 12 is provided inside the housing section 12. A first distance L1 between the deflection detection sensor SE2 and the shaft member 20 is longer than a second distance L2 between an outer circumferential surface RSa of the unused rolled paper RS and the shaft member 20. That is, the deflection detection sensor SE2 is disposed at a position separated from the shaft member 20 further than the outer circumferential surface RSa of the unused rolled paper RS in a diameter direction centering on the shaft member 20. In this embodiment, the deflection detection sensor SE2 is disposed at the lower side in the direction of gravitational force of the shaft member 20. Then, in a case where the sheet SL has come into contact with the deflection detection sensor SE2, a corresponding detection signal is output from the deflection detection sensor SE2 to the control device 60. On the other hand, in a case where the sheet SL does not come into contact with the deflection detection sensor SE2, a corresponding detection signal is output from the deflection detection sensor SE2 to the control device 60.

Next, a description will be made with respect to the transport unit 15.

As shown in FIG. 1, the transport unit 15 includes a sending section 22 for sending the long sheet SL incrementally downstream in the transport direction Y, and a transport roller pair 23 which is disposed at the downstream side in the transport direction Y of the sending section 22. The sending section 22 includes a sending roller 22*a* which is disposed at the back face side of the long sheet SL, and a driven roller 22*b* which is disposed at the surface side of the long sheet SL. That is, the driven roller 22*b* is disposed facing the sending roller 22*a* with the long sheet SL interposed therebetween. Further, a second motor 24 is connected to the sending roller 22*a* in a power-transmittable state.

Then, in a case where a first driving force generated at the second motor 24 is transmitted to the sending roller 22*a*, the sending roller 22*a* rotates in the first rotational direction R1 and also the driven roller 22*b* is driven and rotated following the rotation of the sending roller 22*a*. As a result, the long sheet SL is sent to the downstream side in the transport direction Y by the sending section 22. On the other hand, in a case where a second driving force generated at the second motor 24 is transmitted to the sending roller 22*a*, the sending roller 22*a* rotates in the second rotational direction R2 and also the driven roller 22*b* is driven and rotated following the rotation of the sending roller 22*a*. As a result, the long sheet SL is returned to the inside of the housing section 12 on the upstream side in the transport direction Y by the sending section 22. Accordingly, in this embodiment, a driving section that generates a driving force for rotating the shaft member 20 and the sending roller 22*a* is constituted by the first motor 21, the second motor 24, and the clutch mechanism section 45.

The transport roller pair 23 includes a transport roller 23*a* and a driven roller 23*b*, which are disposed facing each other with the long sheet SL interposed therebetween. As one example, the transport roller 23*a* is disposed at the back face side of the long sheet SL while the driven roller 23*b* is disposed at the surface side of the long sheet SL. A transport motor 25 is connected to the transport roller 23*a* in a power-transmittable state. Then, in a case where a first driving force generated by the transport motor 25 is transmitted to the transport roller 23*a*, the transport roller 23*a* rotates in the first rotational direction and also the driven roller 23*b* is driven and rotated following the rotation of the transport roller 23*a*. As a result, the long sheet SL is sent to the downstream side in the transport direction Y by the transport roller pair 23. On the other hand, in a case where a second driving force generated at the transport motor 25 is transmitted to the transport roller 23*a*, the transport roller 23*a* rotates in the second rotational direction which is a direction opposite to the first rotational direction and also the driven roller 23*b* is driven and rotated following the rotation of the transport roller 23*a*. As a result, the long sheet SL is returned to the upstream side in the transport direction Y by the transport roller pair 23.

A leading end detection sensor SE1 for detecting a downstream end (hereinafter also referred to as a "leading end") in the transport direction Y of the long sheet SL is provided further upstream in the transport direction Y than the transport roller pair 23. A detection signal from the leading end detection sensor SE1 is output to the control device 60 which controls the recording apparatus 11.

Next, a description will be made with respect to the cutting unit 16.

As shown in FIG. 1, the cutting unit 16 includes a cutter 30 which cuts a portion which is located further to the downstream side in the transport direction Y than the cutting position P1, from the long sheet SL. A motor for cutting 32 is connected to the cutter 30 in a power-transmittable state. Then, when a driving force from the motor for cutting 32 is transmitted to the cutter 30, the cutter 30 cuts the long sheet SL.

Next, a description will be made with respect to the discharge unit 17.

As shown in FIG. 1, the discharge unit 17 includes a plurality of (in this embodiment, two) discharge roller pairs 35 and 36 which is disposed along the transport direction Y. The discharge roller pairs 35 and 36 respectively include driving rollers 35*a* and 36*a* and driven rollers 35*b* and 36*b*, which pinch the recorded portion SC. As one example, the driving rollers 35*a* and 36*a* are disposed at the back face side of the recorded portion SC and also the driven rollers 35*b* and 36*b* are disposed at the surface side of the recorded portion SC. A motor for discharge 38 is connected to the driving rollers 35*a* and 36*a* which are located at the back face side of the recorded portion SC, in a power-transmittable state. Then, when a driving force from the motor for discharge 38 is transmitted to the driving rollers 35*a* and 36*a*, the recorded portion SC is discharged to the downstream side in the transport direction Y by the respective discharge roller pairs 35 and 36.

Next, a description will be made with respect to the recording unit 14.

Figure 3:
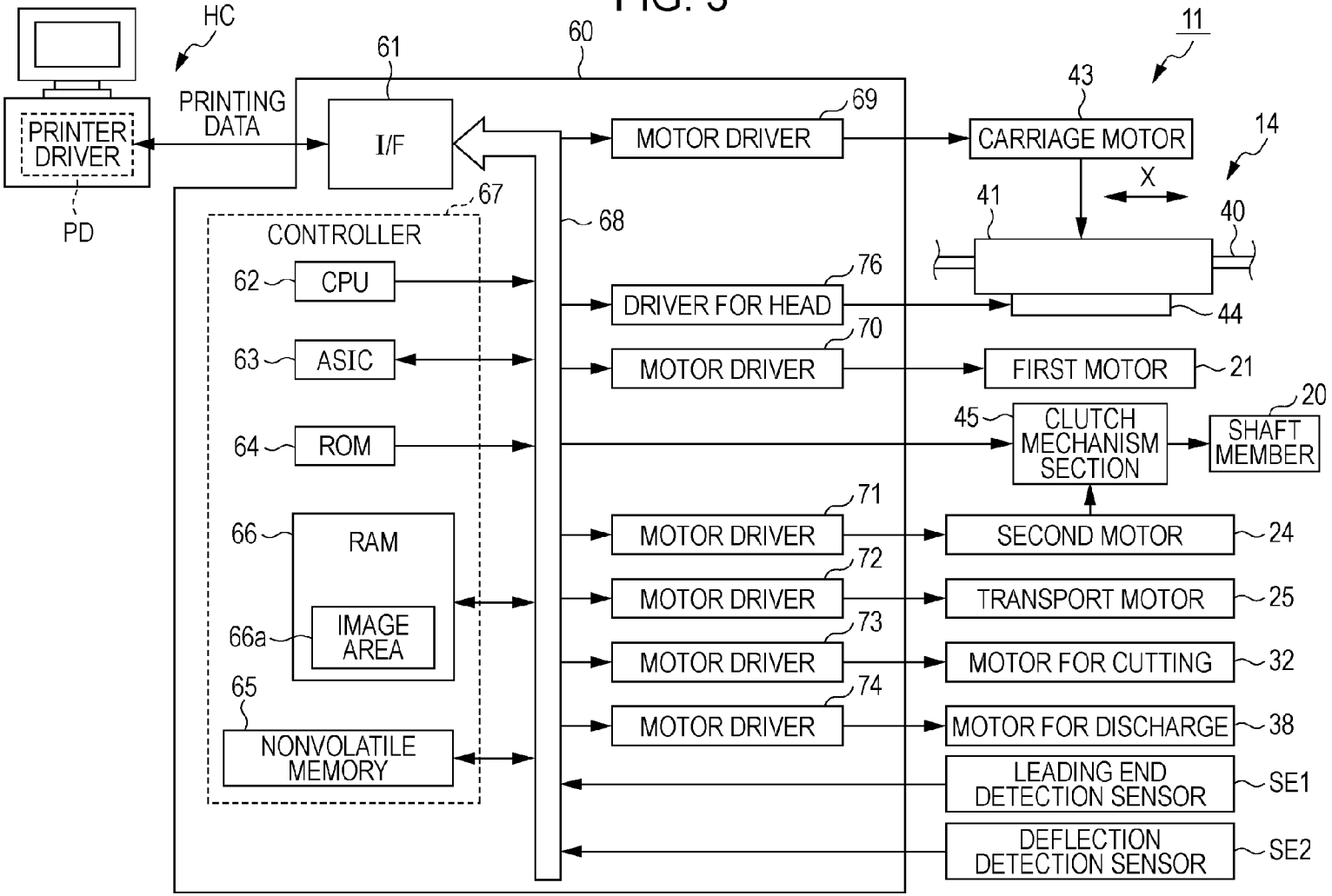
FIG. 3 is a block diagram illustrating a main section of the electrical configuration of the recording apparatus.

As shown in FIGS. 1 and 3, the recording unit 14 includes a guide shaft 40 that extends in a scanning direction X (in FIG. 1, a direction perpendicular to the plane of the paper) perpendicular to the transport direction Y. The guide shaft 40 is supported at both ends in the longitudinal direction thereof on a main body case (not shown) of the recording apparatus 11 and is disposed at the surface side (in FIG. 1, the upper side) of the long sheet SL. A carriage 41 is connected to such a guide shaft 40 in a state where it can reciprocate along the longitudinal direction (that is, the scanning direction X) of the guide shaft 40. The carriage 41 moves along the scanning direction X on the basis of a driving force which is transmitted from a carriage motor 43.

Further, the carriage 41 supports a recording head 44. Ink as one example of fluid is supplied to the recording head 44 from an ink cartridge (not shown) mounted on a holder section (not shown) of the recording apparatus 11 in a detachable state. A plurality of nozzles (not shown) and driving elements corresponding with the respective nozzles are provided in the recording head 44. Then, by the driving of a corresponding driving element, ink is ejected from the nozzle toward the surface (in FIG. 1, the upper face) of the long sheet SL. In addition, a support member (not shown) which supports the corresponding sheet SL is provided at the same position as the recording head 44 in the transport direction Y and at the back face side of the long sheet SL.

Next, a description will be made with respect to the electrical configuration of the recording apparatus 11.

As shown in FIG. 3, the recording apparatus 11 is provided with the control device 60 which, in one embodiment, controls the whole of the recording apparatus 11. The control device 60 is made to be capable of sending and receiving a variety of information such as printing data between itself and a printer driver PD of a host apparatus HC through an interface 61.

The control device 60 includes a controller 67 having a CPU 62, an ASIC 63 (Application Specific IC), a ROM 64, a nonvolatile memory 65, and a RAM 66. The controller 67 is electrically connected to various drivers 69, 70, 71, 72, 73, 74, and 76 through a bus 68. Then, the controller 67 controls the motors 21, 24, 25, 32, 38, and 43 through the motor drivers 69 to 74 and also individually controls the respective driving elements in the recording head 44 through the driver for head 76. Also, the controller 67 controls driving of the clutch mechanism section 45.

In the ROM 64, various control programs, various data, and the like are stored. In the nonvolatile memory 65, various programs including a firmware program, various data necessary for the printing process, and the like are stored. An image area 66*a*, in which printing data received from the host apparatus HC, data during processing of the printing data, and data after the processing are stored, is provided in the RAM 66.

Next, a description will be made with respect to the controller 67 of this embodiment. In addition, in FIG. 4, to facilitate understanding of the explanation of the specification, illustrations of various drivers 69 to 74, and 76 are omitted.

Figure 4:
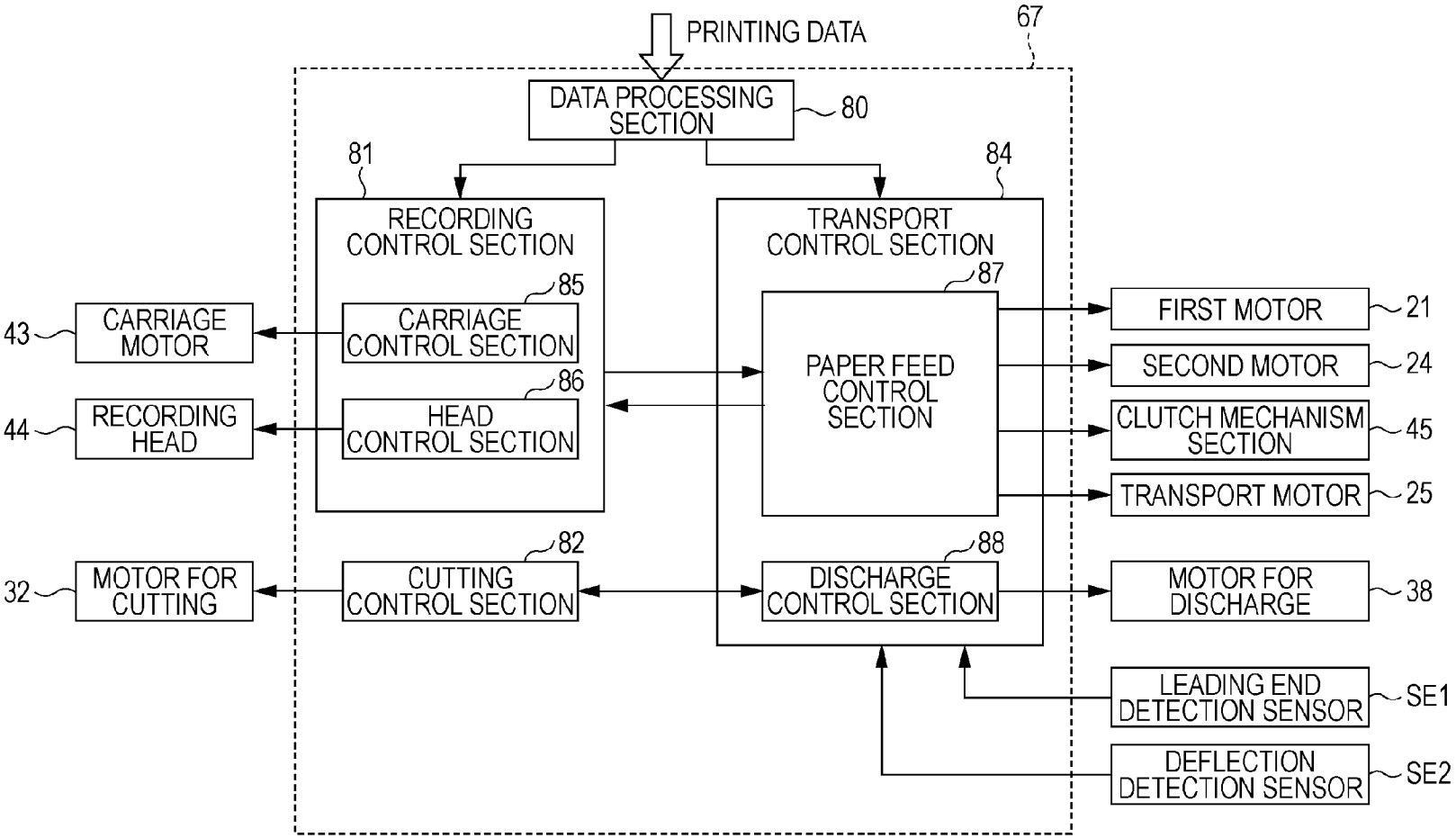
FIG. 4 is a block diagram illustrating a main section of the functional configuration of a controller.

As shown in FIG. 4, the controller 67 includes, as functional sections which are realized by at least one of software and hardware, a data processing section 80, a recording control section 81, a cutting control section 82, and a transport control section 84 as a control section.

The data processing section 80 converts data except for a command among the printing data received through the interface 61 into bitmap data, in which a printing dot is expressed by a gradation value, and then expands the bitmap data. Then, the data processing section 80 generates bitmap data for one pass on the basis of the expanded data and then outputs the bitmap data for one pass to the recording control section 81. In addition, "one pass" refers to movement in the scanning direction X of one time of the recording head 44 (that is, the carriage 41) involving ink ejection.

Further, the data processing section 80 interprets a command which is included in the printing data received through the interface 61, thereby acquiring a recording mode and the unit transport amount of the long sheet SL at the time of recording processing. Then, the data processing section 80 outputs the information about the acquired recording mode to the recording control section 81 and also outputs the information about the acquired unit transport amount to the transport control section 84. In addition, as the recording mode, a draft printing mode with emphasis on a printing speed and a highly-detailed printing mode with emphasis on printing precision can be given as an example.

The recording control section 81 includes a carriage control section 85 and a head control section 86. The carriage control section 85 sets movement control information such as the movement speed, the movement start position, and the stop position of the carriage 41 at the time of recording processing on the basis of the recording mode input from the data processing section 80. Then, the carriage control section 85 controls driving of the carriage motor 43 on the basis of the set movement control information.

The head control section 86 individually controls driving of the respective driving elements (not shown) which are mounted on the recording head 44, on the basis of the input bitmap data for one pass. That is, in this embodiment, the recording control section 81 carries out recording on the long sheet SL by making movement in the scanning direction X of the carriage 41 and driving of the recording head 44 interlock with each other. Then, when recording for one pass is completed, the recording control section 81 outputs that fact to the transport control section 84.

The cutting control section 82 controls driving of the motor for cutting 32 so as to cut the long sheet SL, in a case where a cutting command for the sheet SL is input thereto from the transport control section 84. Then, in a case where cutting of the sheet SL has been completed, the cutting control section 82 stops driving of the motor for cutting 32 and also outputs the fact that cutting has been completed, to the transport control section 84.

To the transport control section 84, the information about the unit transport amount is input from the data processing section 80 and also signals from the leading end detection sensor SE1 and the deflection detection sensor SE2 are input. Such a transport control section 84 includes a paper feed control section 87 and a discharge control section 88. In a case where the leading end of the long sheet SL is detected on the basis of the signal from the leading end detection sensor SE1, the paper feed control section 87 controls driving of the transport motor 25, that is, the transport amount of the long sheet SL on the basis of the detection result. Further, the paper feed control section 87 controls driving of the first motor 21 and the second motor 24 on the basis of a detection signal from the deflection detection sensor SE2. In addition, a method of controlling the first motor 21 and the second motor 24 on the basis of a detection signal from the deflection detection sensor SE2 will be described more fully below.

Further, in a case where it has been detected that the amount of the sheet SL remaining in the housing section 12 is small, the paper feed control section 87 notifies the host apparatus HC of this fact through the interface 61. Then, the paper feed control section 87 causes the clutch mechanism section 45 to be in a release state and maintains the release state of the clutch mechanism section 45 until a new rolled paper RS is set in the housing section 12. On the other hand, the paper feed control section 87 makes the clutch mechanism section 45 be in an engagement state in a case where setting of the new rolled paper RS in the housing section 12 is detected.

Further, if the fact that the recording for one pass has been completed is input from the recording control section 81 at the time of recording processing, the paper feed control section 87 controls driving of the transport motor 25 such that the long sheet SL is transported by a unit transport amount. Then, if the transporting of the long sheet SL is completed, the paper feed control section 87 outputs the effect to the recording control section 81. That is, in this embodiment, transporting of the long sheet SL and ejection of ink by the recording head 44 are alternately performed, whereby an image is recorded on the long sheet SL.

The discharge control section 88 controls driving of the motor for discharge 38 in order to discharge the recorded portion SC cut from the long sheet SL.

Figure 5:
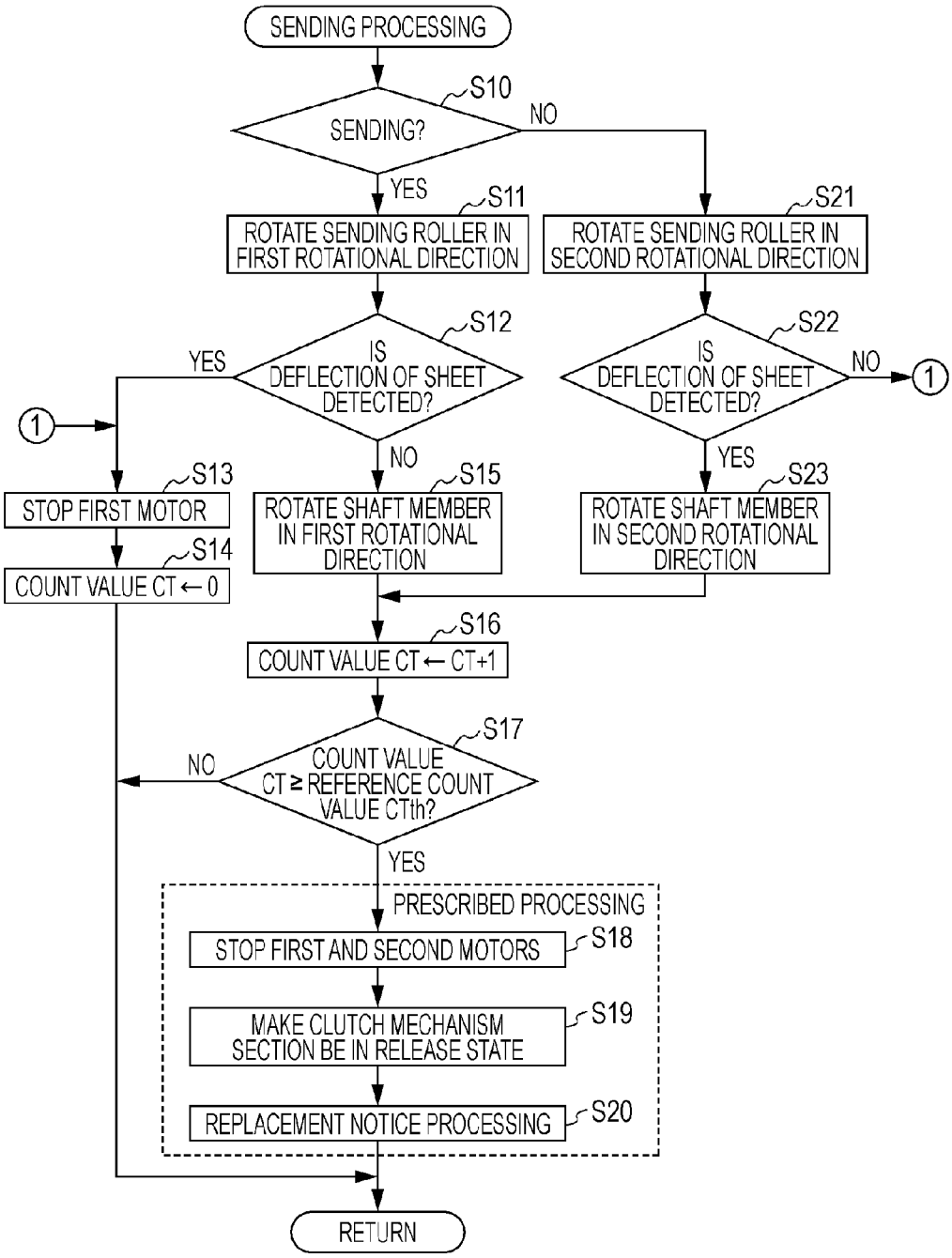
FIG. 5 is a flowchart describing a sending processing routine.

Next, a sending processing routine among various control processing routines that the controller 67 of this embodiment execute will be described on the basis of a flowchart shown in FIG. 5. The sending processing routine is a processing routine for driving the first motor 21 and the second motor 24 on the basis of a detection signal from the deflection detection sensor SE2. Further, the sending processing routine is executed for each predetermined given period in a case where a transport command and a rewinding command are input.

Now, in the sending processing routine, the transport control section 84 interprets the input command, thereby determining whether the sheet SL is sent from the inside of the housing section 12 or not (that is, whether the sheet SL is wound on the shaft member 20) (Step S10). In a case where the determination result is affirmative, the transport control section 84 rotates the sending roller 22*a* in the first rotational direction R1 in order to send the sheet SL from the inside of the housing section 12 (Step S11). That is, the transport control section 84 controls the second motor 24 so as to generate the first driving force.

Subsequently, the transport control section 84 determines whether or not the sheet SL comes into contact with the deflection detection sensor SE2 on the basis of a detection signal from the deflection detection sensor SE2 (Step S12). That is, a detection signal from the deflection detection sensor SE2 is different in a case where the sheet SL comes into contact with the deflection detection sensor SE2 and a case where the sheet SL does not come into contact with the deflection detection sensor SE2. Therefore, in this embodiment, in a case where a portion most separated from the shaft member 20 in the sheet SL is located at the same position as the deflection detection sensor SE2 in the diameter direction centering on the shaft member 20 or a position further away than this position, it is determined that a deflection amount of the sheet SL has become equal to or greater than a predetermined reference amount. Accordingly, in this embodiment, a detection section that determines that the deflection amount of the sheet SL has become equal to or greater than the predetermined reference amount, in a case where a portion which is located at the lowermost end in the direction of gravitational force in the sheet SL is located at the same position as the deflection detection sensor SE2 in the direction of gravitational force or located lower than the position, is constituted by the deflection detection sensor SE2 and the transport control section 84.

In a case where the determination result in Step S12 is affirmative, the transport control section 84 determines that the deflection amount of the sheet SL between the shaft member 20 and the sending roller 22*a* in the transport direction Y is equal to or greater than the reference amount, and stops the first motor 21 (Step S13). That is, the transport control section 84 does not rotate the shaft member 20. Subsequently, the transport control section 84 resets a count value CT to be "0 (zero)" (Step S14) and then temporarily ends the sending processing routine.

On the other hand, in a case where the determination result in Step S12 is negative, the transport control section 84 determines that the deflection amount of the sheet SL between the shaft member 20 and the sending roller 22*a* in the transport direction Y is less than the reference amount, and drives the first motor 21 so as to rotate the shaft member 20 in the first rotational direction R1 (Step S15). That is, the transport control section 84 generates the first driving force from the first motor 21. In addition, the first driving force is set such that an amount of the sheet SL sent from the housing section 12 to the outside becomes greater than a sending amount to the transport roller pair 23 side by the sending section 22 even in a case where the sending roller 22*a* rotates in the first rotational direction R1 in a state where the remaining amount of the sheet SL in the housing section 12 is small.

That is, in this embodiment, in a case where the long sheet SL is transported downstream in the transport direction Y, the shaft member 20 starts to rotate in the first rotational direction R1 at the timing when the sheet SL is made not to come into contact with the deflection detection sensor SE2, and rotation of the sheet SL is stopped at the timing when the sheet SL comes into contact with the deflection detection sensor SE2.

Subsequently, the transport control section 84 increments the count value CT by "1" (Step S16). Since the sending processing routine is a process which is executed for each constant period, the count value CT may also be an elapsed time since the shaft member 20 was started to be rotated by the driving force (the first driving force or the second driving force) from the first motor 21.

Then, the transport control section 84 determines whether or not the count value CT updated in Step S16 is equal to or more than a predetermined reference count value CTth (Step S17). The reference count value CTth is predetermined to be a time required for two rotations of the shaft member 20 which rotates at a constant rotational speed or a time longer than this time. In a case where the determination result in Step S17 is negative (CT<CTth), the transport control section 84 temporarily ends the sending processing routine. That is, while the count value CT is less than the reference count value CTth, the rotation of the shaft member 20 and the rotation of the sending roller 22*a* are individually controlled such that the deflection amount of the sheet SL further to the upstream side in the transport direction Y than the sending roller 22*a* becomes equal to or greater than the reference amount. In this regard, in this embodiment, a rotation control step is constituted by the steps S11, S12, S13, S14, and S15.

On the other hand, in a case where the determination result in Step S17 is affirmative (CT≥CTth), the transport control section 84 determines that the remaining amount of the sheet SL which is housed in the housing section 12 has become small. As described above, the terminus of the long sheet SL is not fixed to the shaft member 20. For this reason, if the remaining amount of the sheet SL which is housed in the housing section 12 becomes small, the terminus of the sheet SL is naturally separated from the shaft member 20. Then, even if the shaft member 20 is rotated in the first rotational direction R1, the sheet SL cannot be sent from the inside of the housing section 12 to the outside. That is, the shaft member 20 idles. Therefore, in this embodiment, in a case where the sheet SL cannot be detected by the deflection detection sensor SE2 even if the shaft member 20 is rotated twice or more, it is determined that the terminus of the long sheet SL has been separated from the shaft member 20 due to the reduced remaining amount of the sheet SL in the housing section 12.

Then, the transport control section 84 performs prescribed processing that is different from the processing before it was determined that the remaining amount of the sheet SL in the housing section 12 has become small (that is, processing in a case where the deflection amount of the sheet SL between the shaft member 20 and the sending roller 22*a* in the transport direction Y is equal to or greater than the reference amount). Specifically, the transport control section 84 stops the first motor 21 and the second motor 24 (Step S18) and makes the clutch mechanism section 45 be in a release state (Step S19). That is, the transport control section 84 blocks power transmission from the first motor 21 to the shaft member 20. Subsequently, the transport control section 84 performs a replacement notice process of the effect that prompts replacement of the rolled paper RS (Step S20). Accordingly, in this embodiment, a prescribed control step is constituted by the steps S18, S19, and S20 which are executed after it is determined that the remaining amount of the sheet SL in the housing section 12 has become small. Thereafter, the transport control section 84 temporarily ends the sending processing routine. If the prescribed processing is executed in this manner, the sending processing routine is not executed until the replacement of the rolled paper RS is detected.

On the other hand, in a case where the determination result in Step S10 is negative, the transport control section 84 rotates the sending roller 22*a* in the second rotational direction R2 in order to wind the sheet SL on the shaft member 20 (Step S21). That is, the transport control section 84 controls the second motor 24 so as to generate the second driving force. Subsequently, the transport control section 84 determines whether or not the sheet SL contacts the deflection detection sensor SE2, on the basis of the detection signal from the deflection detection sensor SE2 (Step S22), similarly to the determination result in the step S12. In a case where the determination result is negative, the transport control section 84 determines that the deflection amount of the sheet SL between the shaft member 20 and the sending roller 22*a* in the transport direction Y is less than the reference amount, and shifts the processing to the above-described step S13.

On the other hand, in a case where the determination result in Step S22 is affirmative, the transport control section 84 determines that the deflection amount of the sheet SL between the shaft member 20 and the sending roller 22*a* in the transport direction Y is equal to or greater than the reference amount, and drives the first motor 21 so as to rotate the shaft member 20 in the second rotational direction R2 (Step S23). That is, the transport control section 84 generates the second driving force from the first motor 21. Then, the transport control section 84 shifts the processing to the above-described step S16.

In the case of winding the sheet SL on the shaft member 20, the rotation of the shaft member 20 and the rotation of the sending roller 22*a* are individually controlled such that the deflection amount of the sheet SL between the shaft member 20 and the sending roller 22*a* in the transport direction Y becomes equal to or less than the reference amount. Specifically, the shaft member 20 starts to rotate in the second rotational direction R2 at the timing when the sheet SL comes into contact with the deflection detection sensor SE2, and the rotation of the sheet SL is stopped at the timing when the sheet SL is made not to come into contact with the deflection detection sensor SE2. Incidentally, in a case where the remaining amount of the sheet SL in the housing section 12 becomes small, such that the terminus of the sheet SL is separated from the shaft member 20, the sheet SL cannot be wound on the shaft member 20 even if the shaft member 20 is rotated in the second rotational direction R2. That is, the shaft member 20 idles.

Therefore, in this embodiment, similarly to the case of transporting the sheet SL to the downstream side in the transport direction Y, in a case where the sheet SL continues to contact the deflection detection sensor SE2 even if the shaft member 20 is rotated twice or more in the second rotational direction R2, it is determined that the remaining amount of the sheet SL in the housing section 12 has become small, such that the terminus of the sheet SL has been separated from the shaft member 20. As a result, the processing of Steps S18 to S20 is executed.

According to the above embodiment, the following advantageous effects can be obtained.

(1) In the case of transporting the long sheet SL to the downstream side in the transport direction Y, the rotations in the first rotational direction R1 of the shaft member 20 and the sending roller 22*a* are individually adjusted such that the deflection amount of the sheet SL between the shaft member 20 and the sending roller 22*a* in the transport direction Y becomes equal to or greater than the reference amount. For this reason, compared to a case where the sheet SL is not deflected between the shaft member 20 and the sending roller 22*a* in the transport direction Y, it is difficult for stress based on the rotation of the sending roller 22*a* to be transmitted to the shaft member 20 through the sheet SL. Further, in the case of winding the long sheet SL on the shaft member 20, the rotations in the second rotational direction R2 of the shaft member 20 and the sending roller 22*a* are individually adjusted such that the deflection amount of the sheet SL between the shaft member 20 and the sending roller 22*a* in the transport direction Y becomes equal to or less than the reference amount. For this reason, compared to a case where the sheet SL is not deflected between the shaft member 20 and the sending roller 22*a* in the transport direction Y, stress based on the rotation of the shaft member 20 is not transmitted to the sending roller 22*a* through the sheet SL. As a result, at the time of transporting the sheet SL, an increase in load which is applied to various members necessary for transporting the sheet SL can be suppressed.

(2) Further, in a case where the first motor 21 and the second motor 24 are driven so as to transport the long sheet SL downstream in the transport direction Y, when the deflection amount of the sheet SL does not become equal to or greater than the reference amount, it is determined that the amount of the sheet SL remaining in the housing section 12 is small. This is because if the amount of the sheet SL remaining in the housing section 12 is small, since the terminus of the sheet SL is not fixed to the shaft member 20, the terminus of the sheet SL is separated from the shaft member 20, so that the sheet SL cannot be sent to the outside even if the shaft member 20 is rotated. In such a case, the prescribed processing that is different from the processing when the deflection amount of the sheet SL between the shaft member 20 and the sending roller 22*a* in the transport direction Y becomes equal to or greater than the reference amount is performed. Accordingly, in a case where the amount of the sheet SL remaining in the housing section 12 has become small, it is possible to perform the prescribed processing that is different from the processing in a case where the remaining amount is sufficient, without increasing a load which is applied to various members necessary for transporting the sheet SL.

(3) Further, in a case where the first motor 21 and the second motor 24 are driven so as to wind the long sheet SL on the shaft member 20, when the deflection amount of the sheet SL does not become equal to or less than the reference amount, it is determined that the amount of the sheet SL remaining in the housing section 12 has become small. In such a case, the prescribed processing that is different from the processing when the deflection amount of the sheet SL between the shaft member 20 and the sending roller 22*a* in the transport direction Y becomes equal to or less than the reference amount is performed. Accordingly, in a case where the amount of the sheet SL remaining in the housing section 12 has become small, it is possible to perform the prescribed processing that is different from the processing in a case where the remaining amount is sufficient, without increasing a load which is applied to various members necessary for transporting the sheet SL.

(4) The deflection amount of the sheet SL can be easily detected by using the deflection detection sensor SE2 provided inside the housing section 12.

(5) Typically, in embodiments where the deflection detection sensor SE2 is disposed at the side (for example, the left side in FIG. 2) of the shaft member 20, it is necessary to provide an additional mechanism for making the sheet SL deflect to the left side in FIG. 2. In this case, it is necessary to complicate either the configuration of the inside of the housing section 12 or the shape of the housing section 12. In this regard, in the embodiment described herein, the deflection detection sensor SE2 is disposed at the lower side in the direction of gravitational force of the shaft member 20 in the housing section 12. The sheet SL deflects to the lower side in the direction of gravitational force due to its own weight. For this reason, since there is no need to specially provide a configuration for making the sheet SL deflect in a direction in which the deflection detection sensor SE2 is disposed, meaning that it is possible to simplify a configuration in the inside of the housing section 12.

(6) In embodiments currently known in the art where the rotation of the shaft member 20 and the rotation of the sending roller 22*a* are controlled with a single motor, it is necessary to provide a mechanism for adjusting the magnitude of a driving force from the motor to the shaft member 20 and a mechanism for adjusting the magnitude of a driving force from the motor to the sending roller 22*a*. For this reason, there is a possibility that the configuration and control of the driving section may be complicated. In contrast to such configurations, however, in the embodiment described herein, the first motor 21 for the shaft member 20 and the second motor 24 for the sending roller 22*a* are separately provided. For this reason, compared to the case of controlling the rotation of the shaft member 20 and the rotation of the sending roller 22*a* with a single motor, it is possible to simplify the configuration and control of the driving section.

(7) In this embodiment, when it is determined that the amount of the sheet SL remaining in the housing section 12 has become small, power transmission from the first motor 21 to the shaft member 20 is blocked. For this reason, wasteful rotation of the shaft member 20 can be avoided. Further, it is possible to prompt the host apparatus HC which is connected to the recording apparatus 11 to replace the rolled paper RS.

For this reason, it is possible to notify a user of a time for replacement of the rolled paper RS at the appropriate timing.

In addition, the above embodiment may be changed as follows.

In the embodiment, in the sending processing routine, in a case where the determination result in Step S17 is affirmative, notice that the remaining amount of the sheet SL in the housing section 12 has become small may also be given. Further, notification may also be given regarding a recordable recording amount (for example, in the case of performing printing of a photograph or the like, the number of printable sheets). That is, it is acceptable if the prescribed processing includes at least one process of a process of blocking power transmission to the shaft member 20, a process of giving notice that the remaining amount of the sheet SL in the housing section 12 has become small, a process of prompting replacement with a new rolled paper RS, and a process of giving notice of a recordable recording amount. However, it is preferable that the prescribed processing includes the process of blocking transmission of a driving force to the shaft member 20.

Figure 6:
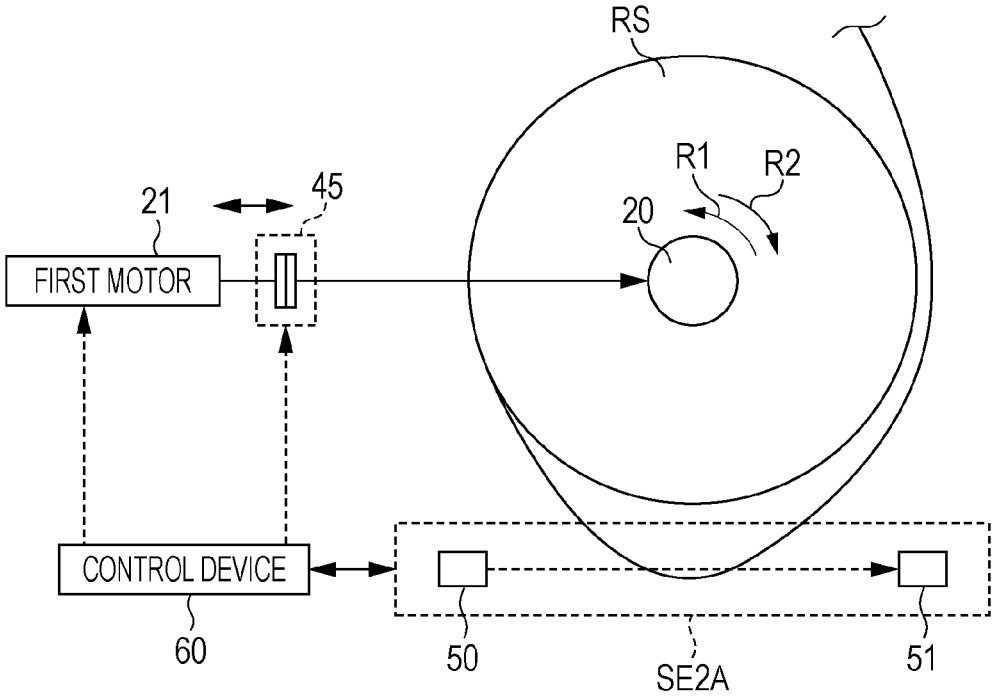
FIG. 6 is a schematic diagram describing a deflection detection sensor of another embodiment of the invention.

In the embodiment, an optical deflection detection sensor (detector) may also be provided at the inside of the housing section 12. As shown in FIG. 6, a deflection detection sensor SE2A includes a light emitting section 50 which emits detection light, and a light receiving section 51 which receives the detection light from the light emitting section 50. In a case where such a deflection detection sensor SE2A is disposed at the lower side in the direction of gravitational force of the shaft member 20, if the deflection amount of the sheet SL is small, the light receiving section 51 can receive the detection light from the light emitting section 50. On the other hand, if the deflection amount of the sheet SL is large, at least a portion of the detection light from the light emitting section 50 is shielded by the sheet SL, such that the amount of light received by the light receiving section 51 becomes small. That is, whether or not the deflection amount of the sheet SL is equal to or greater than the reference amount may also be detected on the basis of a change in the amount of light received by the light receiving section 51.

Further, a magnetic sensor may also be used as the deflection detection sensor.

The sheet SL may also be deflected to the side of the shaft member 20 in the housing section 12. In this case, the deflection detection sensor SE2 is disposed at the side of the shaft member 20.

The motor for rotating the shaft member 20 and the sending roller 22*a* may also be common. In this case, clutch mechanism sections for performing connection and disconnection of power may also be respectively provided at a power transmission path between the motor and the sending roller 22*a* and a power transmission path between the motor and the shaft member 20 and each clutch mechanism section may also be controlled as necessary.

A sensor (for example, a rotary encoder) for detecting a rotational amount of the shaft member 20 may also be provided. Then, in the case of transporting the long sheet SL to the downstream side in the transport direction Y, when the sheet SL does not come into contact with the deflection detection sensor SE2, a rotational amount of the shaft member 20 may also be acquired on the basis of a detection signal from the rotary encoder. Then, in a case where two or more rotations of the shaft member 20 are detected, the prescribed processing may also be executed.

Similarly, in the case of winding the long sheet SL on the shaft member 20, when the sheet SL continues to contact the deflection detection sensor SE2, a rotational amount of the shaft member 20 may also be acquired on the basis of a detection signal from the rotary encoder. Then, in a case where two or more rotations of the shaft member 20 are detected, the prescribed processing may also be executed.

In the case of rotating the shaft member 20 in the first rotational direction R1 or the second rotational direction R2, provided that it is a speed at which a sending amount of the sheet SL based on the rotation of the shaft member 20 becomes greater than a sending amount of the sheet SL based on the rotation of the sending roller 22*a*, the rotational speed of the shaft member 20 may also be set to be an arbitrary speed.

For example, the rotational speed of the shaft member 20 may also be set to be a speed depending on the recording mode (the draft printing mode or the highly-detailed printing mode) at the time. In general, the transport speed of the sheet SL in the draft printing mode becomes a higher speed than the transport speed of the sheet SL in the highly-detailed printing mode. For this reason, the rotational speed of the shaft member 20 in the draft printing mode is set to be a higher speed than the rotational speed of the shaft member 20 in the highly-detailed printing mode.

Further, the rotational speed of the shaft member 20 may also be set regardless of the recording mode. In this case, it is preferable to set the rotational speed of the shaft member 20 such that the sending amount of the sheet SL based on the rotation of the shaft member 20 becomes larger than the sending amount of the sheet SL based on the rotation of the sending roller 22*a* at the time of the draft printing mode.

When the sheet SL comes into contact with the deflection detection sensor SE2 when transporting the long sheet SL downstream in the transport direction Y, driving of the first motor 21 may also be controlled such that the rotational speed in the first rotational direction R1 of the shaft member 20 becomes slow. Further, in a case where the sheet SL does not come into contact with the deflection detection sensor SE2 when transporting the long sheet SL to the downstream side in the transport direction Y, driving of the first motor 21 may also be controlled such that the rotational speed in the first rotational direction R1 of the shaft member 20 becomes fast.

Similarly, in a case where the sheet SL does not come into contact with the deflection detection sensor SE2 when winding the long sheet SL on the shaft member 20, driving of the first motor 21 may also be controlled such that the rotational speed in the second rotational direction R2 of the shaft member 20 becomes slow. Further, in a case where the sheet SL comes into contact with the deflection detection sensor SE2 when winding the long sheet SL on the shaft member 20, driving of the first motor 21 may also be controlled such that the rotational speed in the second rotational direction R2 of the shaft member 20 becomes fast.

The recording unit 14 may also be embodied in a so-called lateral type recording unit in which ink is ejected from the recording head 44 while moving the carriage 41 in the transport direction Y. Further, the recording unit 14 may also be embodied in a so-called line head type recording unit in which the recording head 44 does not move during recording processing.

Provided that it is a medium capable of being cut by a blade section such as the cutter 30, the medium may also be an arbitrary medium such as cloth, a resin film, a resin sheet, or a metal sheet.

The recording apparatus 11 may also be embodied in a fluid ejecting apparatus in which fluid other than ink is ejected or discharged. Further, the recording apparatus 11 may also be embodied in various liquid ejecting apparatuses which are each provided with a liquid ejecting head or the like that discharges a minutely small amount of liquid droplets. In this case, the liquid droplets refers to a liquid in a state of being discharged from the above liquid ejecting apparatus and also includes droplets of a granular shape or a tear shape, or droplets tailing into a line. Further, it is acceptable if the liquid as mentioned herein is a material that can be ejected by a liquid ejecting apparatus. For example, it is acceptable if the liquid is a substance in a state which is a liquid phase, and the liquid includes not only liquids in a liquid state with high or low viscosity, a flow state such as sol, gel water, other inorganic or organic solvents, a solution, a liquid resin, or a liquid metal (metal melt), and one state of substance, but also a material in which particles of a functional material composed of a solid material such as pigment or metal particles are dissolved, dispersed, or mixed in a solvent, or the like. Further, ink as described in the above-described embodiments, a liquid crystal, or the like can be given as representative examples of the liquid. Here, ink is set to include general water-based ink and oil-based ink and various liquid compositions such as gel ink or hot-melt ink. As a specific example of the liquid ejecting apparatus, a liquid ejecting apparatus that ejects liquid that includes, in a dispersed or dissolved form, a material such as an electrode material or a color material, which is used for the manufacturing or the like of, for example, a liquid crystal display, an EL (electroluminescence) display, a surface-emitting display, or a color filter, can be given. Further, the liquid ejecting apparatus may also be a liquid ejecting apparatus that ejects a biological organic matter that is used for the manufacturing of biochips, a liquid ejecting apparatus that is used as a precision pipette and ejects liquid that is a sample, a cloth printing apparatus, a micro-dispenser, or the like. Then, the invention can be applied to any one type of liquid ejecting apparatus among these liquid ejecting apparatuses. Further, the fluid may also be a powder granular material such as toner.

In addition, the fluid as mentioned in this specification may comprise a liquid or a solid or any other configuration so long as the fluid does is not entirely composed of gas. Further, the recording as mentioned in this specification is not limited to printing on a sheet such as paper, but is a concept that includes formation of a circuit by recording by adhering ink (or paste) prepared by a material for an element or a wiring onto a substrate (recording medium) when manufacturing, for example, an electric circuit.

In the embodiment, the recording apparatus 11 may also be a recording apparatus which carries out recording on a medium by another recording method such as a dot impact method or a laser method.

Next, the technical ideas that can be grasped from the above embodiment and other embodiments will be additionally described below.

(A) A transport apparatus in which when transporting the medium downstream in the transport direction, the control section controls the driving section such that the first driving force is imparted to the shaft member, when the deflection amount of the medium that is detected by the detection section has become less than the reference amount, and controls the driving section such that the first driving force is not imparted to the shaft member, when the deflection amount of the medium that is detected by the detection section has become equal to or greater than a reference amount.

(B) A transport apparatus in which when winding the medium on the shaft member, the control section controls the driving section such that the second driving force is imparted to the shaft member, when the deflection amount of the medium that is detected by the detection section has become equal to or greater than the reference amount, and controls the driving section such that the second driving force is not imparted to the shaft member, when the deflection amount of the medium that is detected by the detection section has become less than the reference amount.

(C) A transport apparatus in which the detector is disposed at the lower side in the direction of gravitational force of the shaft member.

(D) A transport apparatus in which when transporting the medium downstream n the transport direction, the control section performs the prescribed processing in a case where the deflection amount of the medium that is detected by the detection section does not become equal to or greater than the reference amount even if an elapsed time since the shaft member is started to rotate becomes equal to or more than the predetermined reference time.

(E) A transport apparatus in which when transporting the medium downstream in the transport direction, the control section performs the prescribed processing in a case where the deflection amount of the medium that is detected by the detection section does not become equal to or greater than the reference amount even if the rotational amount of the shaft member becomes equal to or greater than the predetermined prescribed rotational amount.

(F) A transport apparatus in which the control section permits transmission of power from the driving section to the sending roller in a case where replacement of the medium has been detected after the prescribed processing.

What is claimed is:

1. A transport device that transports a long medium so as to send the medium downstream in a transport direction by rotating a shaft member on which the long medium is wound in a roll form, the transport device comprising:

a sending roller that is disposed further downstream in the transport direction than a housing section where the medium wound in a roll form on the shaft member is housed, the sending roller feeding the medium downstream in the transport direction;

a driving section that generates driving force for rotating the shaft member and the sending roller;

a detection section that detects a deflection amount of the medium between the shaft member and the sending roller in the transport direction; and a control section that controls, when transporting the medium downstream in the transport direction, the driving section such that the deflection amount of the medium detected by the detection section becomes equal to or greater than a predetermined reference amount, wherein when the driving section is driven so as to transport the medium downstream in the transport direction, the control section performs prescribed processing that is different from when the deflection amount becomes equal to or greater than the predetermined reference amount when the deflection amount of the medium detected by the detection section does not become equal to or greater than the predetermined reference amount, wherein the driving section can generate a first driving force that rotates the sending roller and the shaft member in a first rotational direction so as to transport the medium downstream in the transport direction and a second driving force that rotates the sending roller and the shaft member in a second rotational direction that is a direction opposite to the first rotational direction, so as to wind the medium on the shaft member, and wherein the control section:

when winding the medium on the shaft member, the control section controls the driving section such that the deflection amount of the medium detected by the detection section becomes equal to or less than the predetermined reference amount, and while the driving section is driven so as to wind the medium on the shaft member, if the deflection amount of the medium does not become equal to or greater than the reference amount, the control section performs a prescribed processing is performed which is different from when the deflection amount becomes equal to or less than the predetermined reference amount, when the deflection amount of the medium detected by the detection section continues for a predetermined period of time while the shaft member is rotated in the second direction, the control section determines that the remaining amount of medium on the roll has become low.

2. The transport device according to claim 1, wherein the detection section includes a detector that is disposed in the housing section, and wherein the detector is disposed further outside than the outer circumferential surface of the roll-shaped medium in the diameter direction centering on the shaft member, when the unused roll-shaped medium in which the medium is wound in a roll form on the shaft member is installed in the housing section.

3. A recording apparatus comprising:

the transport device according to claim 2; and a recording section that is disposed further downstream in the transport direction than the sending roller and which attaches fluid to the medium.

4. The recording apparatus according to claim 3, wherein the prescribed processing includes at least one process of the group consisting of:

a process of blocking power transmission to the shaft member, a process of giving notice of the effect that the remaining amount of the medium in the housing section has become small, a process of prompting replacement with a new medium, and a process of giving notice of a recording-processable recording amount.

5. The transport device according to claim 1, wherein the driving section includes a first motor that generates a driving force for rotating the shaft member and a second motor that generates a driving force for rotating the sending roller.

6. A recording apparatus comprising:

the transport device according to claim 5; and a recording section that is disposed further downstream in the transport direction than the sending roller and which attaches fluid to the medium.

7. The recording apparatus according to claim 6, wherein the prescribed processing includes at least one process of the group consisting of:

a process of blocking power transmission to the shaft member, a process of giving notice of the effect that the remaining amount of the medium in the housing section has become small, a process of prompting replacement with a new medium, and a process of giving notice of a recording-processable recording amount.

8. A recording apparatus comprising:

the transport device according to claim 1; and a recording section that is disposed further downstream in the transport direction than the sending roller and which attaches fluid to the medium.

9. The recording apparatus according to claim 8, wherein the prescribed processing includes at least one process of the group consisting of:

a process of blocking power transmission to the shaft member, a process of giving notice of the effect that the remaining amount of the medium in the housing section has become small, a process of prompting replacement with a new medium, and a process of giving notice of a recording-processable recording amount.

10. A recording apparatus comprising: the transport device according to claim 1; wherein the prescribed processing includes at least one process of the group consisting of:

a process of blocking power transmission to the shaft member, a process of giving notice of the effect that the remaining amount of the medium in the housing section has become small, a process of prompting replacement with a new medium, and a process of giving notice of a recording-processable recording amount.

11. A recording apparatus comprising:

a transport device that transports a long medium so as to send the medium downstream in a transport direction by rotating a shaft member on which the long medium is wound in a roll form;

a recording section that is disposed further downstream in the transport direction than the sending roller and which attaches fluid to the medium; and a cutting section that is disposed further downstream in the transport direction than the recording section and which cuts the long medium after the fluid is attached to the medium, wherein the transport device includes:

a sending roller that is disposed further downstream in the transport direction than a housing section where the medium wound in a roll form on the shaft member is housed, the sending roller feeding the medium downstream in the transport direction;

a driving section that generates driving force for rotating the shaft member and the sending roller;

a detection section that detects a deflection amount of the medium between the shaft member and the sending roller in the transport direction; and a control section that controls, when transporting the medium downstream in the transport direction, the driving section such that the deflection amount of the medium detected by the detection section becomes equal to or greater than a predetermined reference amount, wherein when the driving section is driven so as to transport the medium downstream in the transport direction, the control section performs prescribed processing that is different from when the deflection amount becomes equal to or greater than the predetermined reference amount when the deflection amount of the medium detected by the detection section does not become equal to or greater than the predetermined reference amount, wherein the driving section can generate a first driving force that rotates the sending roller and the shaft member in a first rotational direction so as to transport the medium downstream in the transport direction and a second driving force that rotates the sending roller and the shaft member in a second rotational direction that is a direction opposite to the first rotational direction, so as to wind the medium on the shaft member, and wherein the control section:

when winding the medium on the shaft member, the control section controls the driving section such that the deflection amount of the medium detected by the detection section becomes equal to or less than the predetermined reference amount, and while the driving section is driven so as to wind the medium on the shaft member, if the deflection amount of the medium does not become equal to or greater than the reference amount, the control section performs a prescribed processing is performed which is different from when the deflection amount becomes equal to or less than the predetermined reference amount, when the deflection amount of the medium detected by the detection section continues for a predetermined period of time while the shaft member is rotated in the second direction, the control section determines that the remaining amount of medium on the roll has become low.

* * * * *